US006098806A

United States Patent [19]

Mills

[11] Patent Number: 6,098,806

[45] Date of Patent: Aug. 8, 2000

[54] STORAGE AND DISPENSING UNIT FOR MERCHANDISE BAGS

[75] Inventor: Daniel J. Mills, Reedsville, Pa.

[73] Assignee: Trinity Packaging Corporation, Armonk, N.Y.

[21] Appl. No.: 09/412,720

[22] Filed: Oct. 5, 1999

Related U.S. Application Data

[60] Provisional application No. 60/103,048, Oct. 5, 1998.

[51] Int. Cl.[7] ..... B65D 85/62

[52] U.S. Cl. ..... 206/554; 206/494; 221/45; 383/37

[58] Field of Search ..... 206/449, 494, 206/499, 554; 221/45, 63; 383/7–9, 11, 37

[56] References Cited

U.S. PATENT DOCUMENTS

| | | | |
|---|---|---|---|
| 3,346,104 | 10/1967 | Marsh | 206/494 |
| 4,527,693 | 7/1985 | Membrino | 206/554 |
| 4,537,330 | 8/1985 | Gelbard | 221/45 |
| 5,176,286 | 1/1993 | Snowdon | 221/45 |
| 5,368,165 | 11/1994 | Nguyen | 206/554 |
| 5,524,763 | 6/1996 | Wile | 206/554 |
| 5,655,682 | 8/1997 | Hoffrichter | 221/45 |
| 5,695,065 | 12/1997 | Kennedy et al. | 206/554 |

*Primary Examiner*—Jim Foster
*Attorney, Agent, or Firm*—Darby & Darby

[57] ABSTRACT

A pack of merchandise bags is provided in a closed storage and dispensing unit. A portion of the unit is removable to provide a window through which the bag pack is exposed. Each bag in the pack is provided with a front and rear tab at the top, with the rear tab of a bag being attached to the front tab of the next bag. In addition, the rear tabs are formed together in a stack which is secured inside the unit, and each rear tab is attached to its respective bag through a relatively weak perforation. Thus, when a bag is withdrawn from the back pack by means of the front tab, the bag is opened, because the rear tab is retained to the stack of tabs. However, as additional force is exerted on the bag, the rear tab is torn free at the perforation. Since this rear tab is attached to the front tab of the next bag, the next bag is automatically opened.

18 Claims, 3 Drawing Sheets

FIG. 3
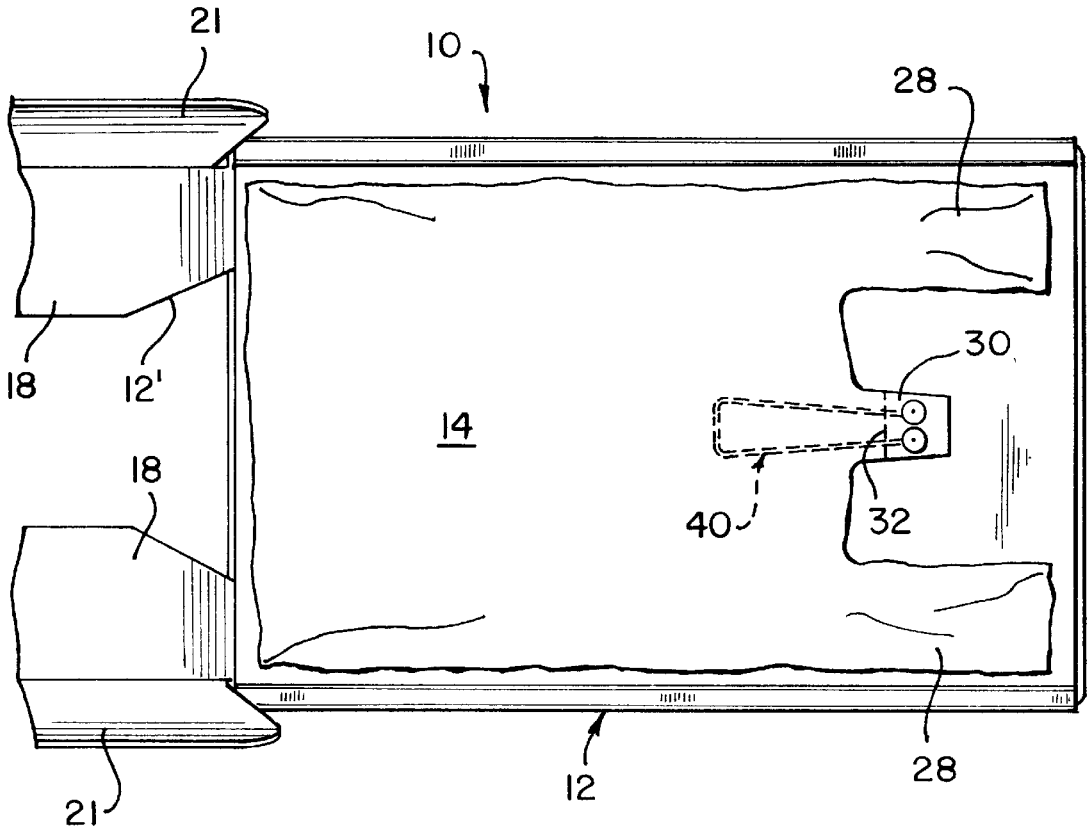
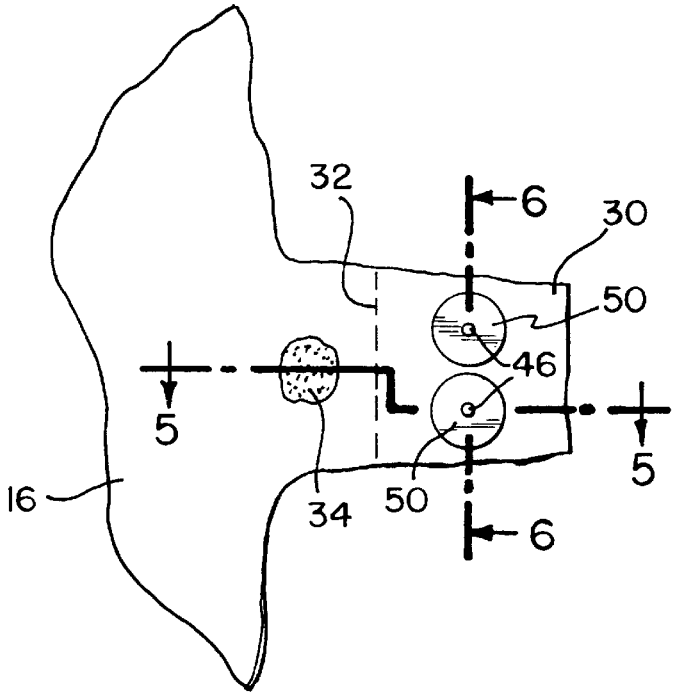
FIG. 4

STORAGE AND DISPENSING UNIT FOR MERCHANDISE BAGS

This patent application claims the priority of U.S. Provisional Patent Application No. 60/103,048 filed Oct. 5, 1998.

FILED OF THE INVENTION

The present invention relates generally to merchandise bags and, more particularly, concerns a unit for storing and dispensing a plurality of merchandise bags.

BACKGROUND OF THE INVENTION

Plastic film bags are now the most common form of carry-out merchandise bags. A typical merchandise bag has the appearance of a basketball shirt. That is, it is has opposed front and rear walls connected by side gussets, and side handles are provided which are upward extensions of the front and rear walls, The handles are formed as closed loops, to permit carrying of the filled bags. This type of merchandise bag has commonly been referred to as a T-shirt bag.

Plastic film merchandise bags suffer from two major shortcomings. First of all, the front and rear walls tend to cling together, making the bags difficult to open. Secondly the plastic film of which the bags are composed exhibits very little stiffness, so that even after the bags are opened, they will not stand freely, hampering filling of the bags.

In order to cope with the shortcomings of plastic merchandise bags, numerous dispensing systems have been devised. Typically, they include some form of rack on which a pack of stacked bags is mounted. As a bag is removed from the pack, it is supported by the rack while being filled and may be removed from the rack when full. Although the rack offers some assistance in filling the bag, mounting bag packs on the rack is difficult and cumbersome. Although rack mounted systems have been of some benefit in grocery applications, they occupy too much space for general merchandise applications and tend to slow down the operation of the merchandise checkout counter. In effect, any benefit that may be gained by using the rack is effectively lost. As a practical matter, a checkout clerk is able to operate more efficiently without a rack, if he can quickly and consistently open consecutive bags for filling, even if they are not supported.

In accordance with the present invention, a pack of merchandise bags is provided in a closed storage and dispensing unit. A portion of the unit is removable to provide a window through which the bag pack is exposed. Each bag in the pack is provided with a front and rear tab at the top, with the rear tab of a bag being attached to the front tab of the next bag. In addition, the tabs are formed together in a stack which is secured inside the unit, and each rear tab is attached to its respective bag through a relatively weak perforation. Thus, when a bag is withdrawn from the back pack by means of the front tab, the bag is opened, because the rear tab is retained to the stack of tabs. However, as additional force is exerted on the bag, the rear tab is torn free at the perforation. Since this rear tab is attached to the front tab of the next bag, the next bag is automatically opened.

By mounting the pack of bags so that the window of the unit exposes the bottom of the bags, the withdrawal of the first bag causes the portion of the second bag containing the front tab to pop up from the window in the unit in the manner of a facial tissue dispenser. The second bag is, therefore, easily withdrawn from the unit and opened at the same time and, when fully withdrawn, will cause the front tab of the third bag to pop up. Thus, the unit permits consecutive bags to be quickly and easily opened by the operator. After the last bag of the pack is used, the unit may be disposed of.

BRIEF DESCRIPTION OF THE DRAWINGS

The foregoing brief description, as well as other objects, features, and advantages of the present invention will be understood more completely from the following detailed description of a presently preferred, but nonetheless illustrative, embodiment, with reference being had to the accompanying drawings, in which:

FIG. 3 is a top view of the storage and dispensing unit of FIG. 1, the unit being shown opened up to reveal interior details;

FIG. 4 is a fragmentary view, on an enlarged scale, showing the tab portion of the bag pack of FIG. 3;

DETAILED DESCRIPTION OF THE PREFERRED EMBODIMENT

Figure 1:
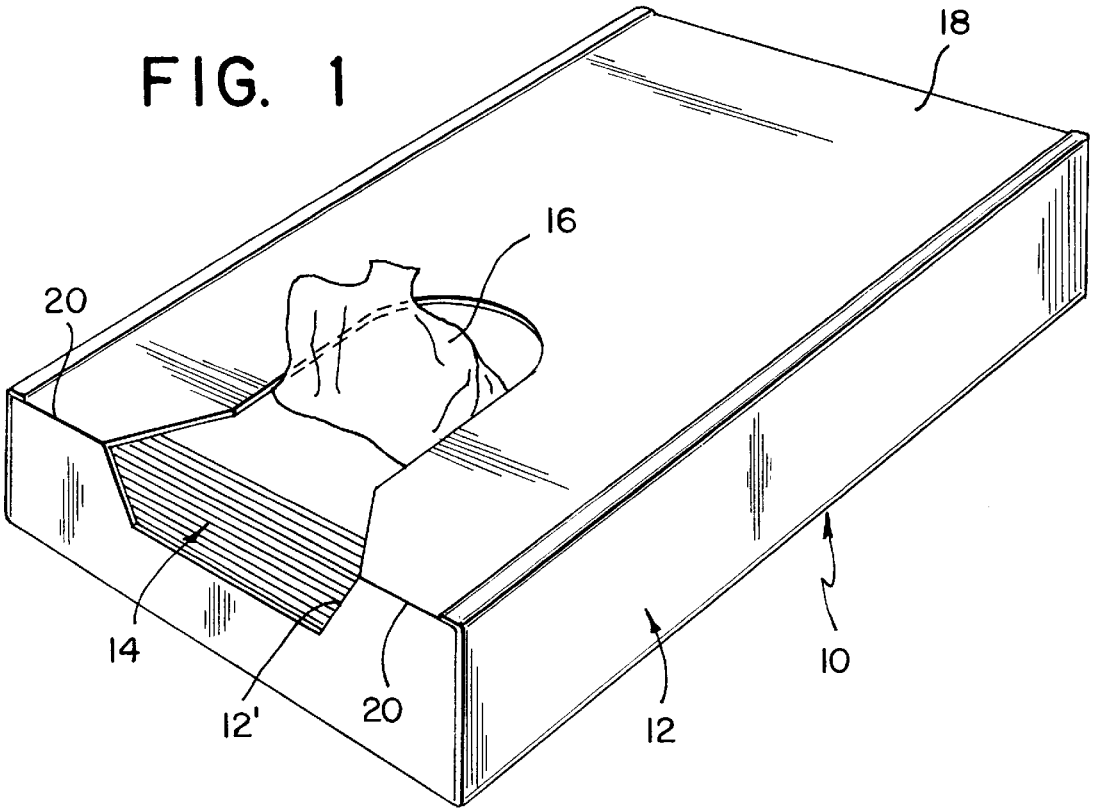
FIG. 1 is a perspective view of a merchandise bag storage and dispensing unit embodying the present invention, the unit being shown with the dispensing window exposed and a portion of a merchandise bag protruding thereabove, ready for use.

Turning now to the drawings, FIG. 1 is a perspective view illustrating a preferred embodiment of a merchandise bag storage and dispensing unit 10 in accordance with the present invention. Unit 10 includes a housing 12 in which there is mounted a bag pack 14, the lower portion of which may be seen through a window 12' in housing 12. In use as a dispenser, the unit 10 will typically have a portion of a bag 1 6 from bag pack 14 protruding through window 12', which permits bag 16 to be grasped easily for removal.

Figure 2:
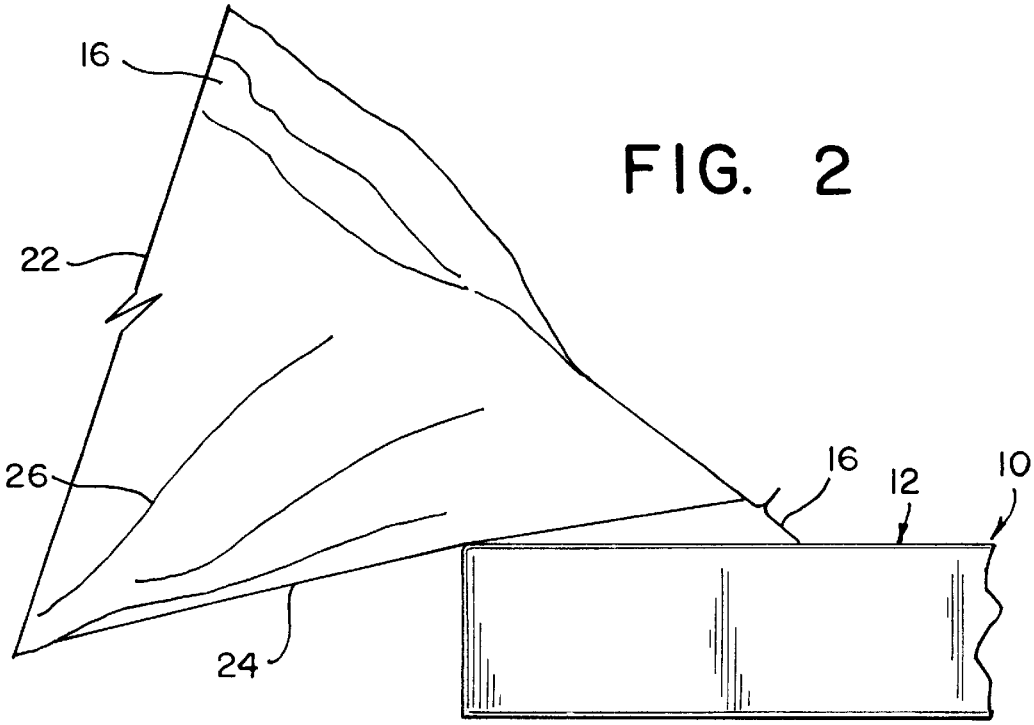
FIG. 2 is a fragmentary side view of the storage and dispensing unit of FIG. 1 illustrating a merchandise bag after being withdrawn from the unit, the bag having been opened in the process, and a portion of the next following bag being drawn through the window of the unit.
Figure 5:
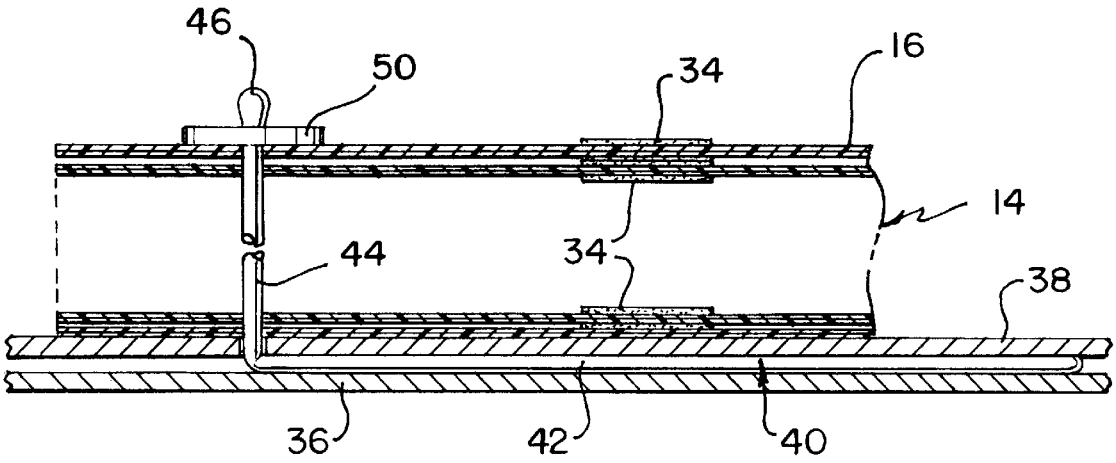
FIG. 5 is a sectional view taken along contour 5—5 in FIG. 4 and looking in the direction of the arrows.
Figure 6:
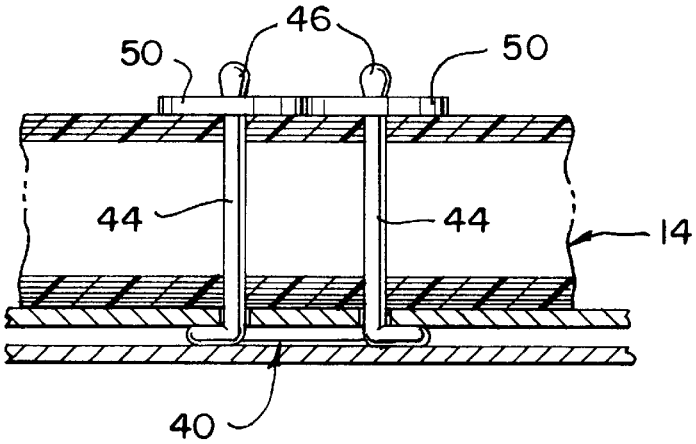
FIG. 6 is a sectional view taken along the line 6—6 in FIG. 4 and looking at the direction of the arrows.

As best seen in FIG. 2, when bag 16 is removed from housing 12, a rear portion of bag 16 remains attached to the next bag in the pack, causing bag 16 to be opened as it is removed. At the same time, the lead portion of the next bag (16+) in bag pack 14 is drawn through window 12'.

Housing 12 is preferably made of corrugated cardboard. The top 18 of housing 12 is preferably hinged at 20 so as to permit it to fold down. It also includes side flaps 21 which are folded down and tucked inside the housing after the bag pack 14 is mounted therein, permitting the housing to be closed, as shown in FIG. 1. The top 18 may be retained in a closed position, as by taping.

Preferably, the window 12' is formed by providing a perforated portion of housing 12. This perforated portion is left in position when the unit is stored, but is removed from the housing, to form window 12', when dispensing is desired.

Bag pack 14 contains a plurality of plastic bags in stacked alignment. Each bag 16 of the bag pack includes a front wall 22 and an opposed rear wall 24 which are joined together by side gussets 26. The bags are preferably of the type having the general shape of a basketball shirt, in which side handles 28, 28 are formed as integral extensions of the front and rear walls and joined at the top to provide loop handles on either lateral side of the bag. Each bag also includes a central tab 30 formed in the front and rear walls, and all of the bag tabs are secured together in a stack by means described below. Thus, the bag pack is securely mounted by means of the tabs 30 within the housing 12.

Preferably, the tab 30 in the rear wall of each bag is formed with a perforation 32 below the point at which the tabs are attached together, and the tab 30 in the front wall of each bag is preferably severed in the proximity of perforation 32, to provide a free front wall for each bag. The rear wall tab of each bag is secured to the front wall tab of the next following bag at 34 by means of a glue spot, a cold seal, a hot weld, or the like. Thus, when a bag is withdrawn, as shown in FIG. 2, the perforation 32 in the rear wall tab 30 is eventually torn, permitting complete removal of the bag in its open condition. However, the connection at 34 causes the free front of the next following bag to be drawn through window 12'.

As can be seen in FIG. 3, the bag pack 14 is mounted so that the bottom of the bag pack is visible through window 12'. Thus, a bag which has its front wall drawn through window 12' essentially has its front wall doubled over on itself. This causes increased resistance of the bag to removal as it is drawn through window 12'. The connection at 34 is designed to release the two walls jointed by connection 34, when the force on the connection exceeds a predetermined value. That value is exceeded when a portion of the next following back has doubled back and protrudes through the window 12'. Thus, the bag that has been withdrawn from the housing 12 is fully released and the portion of the next following bag is left protruding from the window 12', to permit convenient removal of the next following bag.

A stack of bag tabs 30 is preferably retained within the housing 12 by means of a stiff wire loop 40. The main portion 42 of loop 40 is retained within the housing by being captured between the bottom wall 36 of the housing and a corrugated cardboard insert 38 which is glued or otherwise secured to the bottom wall 36. Each end 44 of loop 40 is bent upward in an L-shape and passes through a corresponding hole formed in the bag tabs 30. Each end of loop 42 is formed with a bulb portion 46, and a washer 50 is forced down over each bulb of portion 46, to retain the stack of bag tabs 30 in stacked alignment. This forms the bag pack 14 and retains it securely within housing 12. Those skilled in the art will appreciate that the stack of tabs 30 could also be secured within the housing by means of staple, a wicket, a wire tie or any similar means.

From the foregoing description, it will be appreciated that the present invention provides a merchandise bag unit which is relatively inexpensive in construction and provides protective storage for the contained bag pack. When dispensing of bags is desired, a perforated portion of the housing may be removed to reveal the window 12', in which the bottom of the bag pack 14 is visible. The bottom of the first bag may then be grasped and the bag pulled out of the housing. This causes the lead portion of the next following bag to protrude from the housing as shown in FIG. 1, as will every following bag. The protruding portions of the bags are therefore quickly and easily grasped and pulled through window 12', causing them to open, ready for filling. Owing to the inexpensive construction, when the last bag in the bag pack is used, the entire unit may be disposed of. The corrugated cardboard housing is readily biodegradable and, so does not present a disposal problem.

Although a preferred form of the invention has been disclosed for illustrative purposes, those skilled in the art will appreciate that many additions, modifications and substitutions are possible, without departing from the scope and spirit of the invention.

What is claims is:

1. A storage and dispensing unit for merchandise bags, comprising:

a housing having first and second opposing walls;

a bag pack disposed in said housing between said walls and comprising a plurality of merchandise bags, each bag having:

front and rear walls, an upwardly extending tab formed as an extension of the rear wall, and a weakened section formed below the top of the tab to provide a weakened connection between at least a detachable portion of the tab and the rear wall of the bag, a portion of the rear wall of a bag outside the detachable portion being attached to the front wall of the next following bag;

the detachable portions of the bag tabs being connected together and to the first wall of the housing; and the second wall of the housing having a window formed herein to permit access to the bags.

2. The storage and dispensing unit of claim 1 wherein the weakened section is formed by providing a perforation extending across the tab.

3. The storage and dispensing unit of claim 1 wherein the attachment between the rear wall of a bag and the front wall of the next following bag is provided by one of a glue spot, a cold seal and a hot weld.

4. The storage and dispensing unit of claim 1 wherein the detachable portions of the bag tabs and the first wall of the housing are attached together by a retainer which extends through the bag tabs and is secured to the first wall of the housing.

5. The storage and dispensing unit of claim 1 wherein the housing is constructed so that the second wall can be pivoted to access the interior thereof, to permit the bag pack to be mounted therein.

6. The storage and dispensing unit of claim 1 wherein said housing is made of corrugated cardboard.

7. The storage and dispensing unit of claim 1 wherein said window is formed by providing a weakened contour in said second wall to permit removal of a section thereof.

8. The storage and dispensing unit of claim 1 wherein said window is positioned to expose the bottoms of said bags.

9. The storage and dispensing unit of claim 8 wherein the weakened section is formed by providing a perforation extending across the tab.

10. The storage and dispensing unit of claim 9 wherein the attachment between the rear wall of a bag and the front wall of the next following bag is provided by one of a glue spot, a cold seal and a hot weld.

11. The storage and dispensing unit of claim 10 wherein the detachable portions of the bag tabs and the first wall of the housing are attached together by a retainer which extends through the bag tabs and is secured to the first wall of the housing.

12. The storage and dispensing unit of claim 8 wherein the attachment between the rear wall of a bag and the front wall of the next following bag is provided by one of a glue spot, a cold seal and a hot weld.

13. The storage and dispensing unit of claim 12 wherein the detachable portions of the bag tabs and the first wall of the housing are attached together by a retainer which extends through the bag tabs and is secured to the first wall of the housing.

14. The storage and dispensing unit of claim 8 wherein the housing is constructed so that the second wall can be pivoted to access the interior thereof, to permit the bag pack to be mounted therein.

15. The storage and dispensing unit of claim 14 wherein said housing is made of corrugated cardboard.

16. The storage and dispensing unit of claim 8 wherein said housing is made of corrugated cardboard.

17. The storage and dispensing unit of claim 8 wherein said window is formed by providing a weakened contour in said second wall to permit removal of a section thereof.

18. The storage and dispensing unit of claim 17 wherein said housing is made of corrugated cardboard.

* * * * *